US008468991B2

(12) United States Patent
Niiro

(10) Patent No.: US 8,468,991 B2
(45) Date of Patent: Jun. 25, 2013

(54) ELECTROMAGNETIC-CLUTCH ROTATION STOPPING STRUCTURE

(75) Inventor: Masaaki Niiro, Hadano (JP)

(73) Assignee: Nittan Valve Co., Ltd., Hadano-shi (JP)

( * ) Notice: Subject to any disclaimer, the term of this patent is extended or adjusted under 35 U.S.C. 154(b) by 0 days.

(21) Appl. No.: 13/517,078

(22) PCT Filed: Dec. 22, 2009

(86) PCT No.: PCT/JP2009/071318

§ 371 (c)(1),
(2), (4) Date: Jun. 19, 2012

(87) PCT Pub. No.: WO2011/077516

PCT Pub. Date: Jun. 30, 2011

(65) Prior Publication Data

US 2012/0247912 A1 Oct. 4, 2012

(51) Int. Cl.
*F01L 1/34* (2006.01)

(52) U.S. Cl.
USPC ..... 123/90.17; 123/90.11

(58) Field of Classification Search
USPC ..... 123/90.15, 90.17, 90.31, 90.11
See application file for complete search history.

(56) References Cited

U.S. PATENT DOCUMENTS

| | | | | |
|---|---|---|---|---|
| 2002/0038639 | A1* | 4/2002 | Mae et al. | 123/90.17 |
| 2005/0045127 | A1 | 3/2005 | Aino et al. | |
| 2009/0183704 | A1 | 7/2009 | Shiino et al. | |

FOREIGN PATENT DOCUMENTS

| | | | |
|---|---|---|---|
| JP | 8-145076 | A | 6/1996 |
| JP | 2002-371814 | A | 12/2002 |
| JP | 2008-19817 | A | 1/2008 |
| JP | 2008-75877 | A | 4/2008 |
| WO | 2008/015746 | A1 | 2/2008 |

OTHER PUBLICATIONS

International Search Report for PCT/JP2009/071318 mailing date Mar. 9, 2010.

* cited by examiner

*Primary Examiner* — Zelalem Eshete
(74) *Attorney, Agent, or Firm* — Westerman, Hattori, Daniels & Adrian, LLP

(57) ABSTRACT

An axially short electromagnetic-clutch rotation stopping structure for use with a phase varying apparatus (30) of an automobile engine, adapted to stop the rotation of an electromagnetic clutch (35) relative to an electromagnetic clutch cover (70) while braking the brake drum (34) of the phase varying apparatus (30) to vary the phase angle of the camshaft (45) of the apparatus (30) relative to the crankshaft of the engine. An electromagnetic clutch cover (70) has a clutch holding section (71) for accommodates a substantially C-shaped leaf spring (73). The electromagnetic clutch (35) is held unrotatable with respect to the clutch holding section (71) by first rotation stopping means (71*e*, 73*a*) provided between the electromagnetic clutch (35) and by second rotation stopping means (73*b*, 35*d*) provided between the leaf spring (73) and the electromagnetic clutch (35).

4 Claims, 10 Drawing Sheets

(a)

(b)

(a)

(b)

(a)

(b)

ELECTROMAGNETIC-CLUTCH ROTATION STOPPING STRUCTURE

FIELD OF THE INVENTION

This invention relates to a phase varying apparatus for varying the valve timing or an automobile engine by actuating an electromagnetic clutch to put a brake on the brake drum connected to the crankshaft of the engine, thereby rotating the camshaft of the apparatus relative to the sprocket connected to the crankshaft to change the phase angle of the camshaft relative to the sprocket. More particularly, the invention relates to a structure for stopping the rotation of the electromagnetic clutch relative to the electromagnetic clutch cover of the apparatus (the structure hereinafter referred to as electromagnetic-clutch rotation stopping structure).

BACKGROUND ART

A phase varying apparatus for an automobile engine has a camshaft, sprocket coaxial with the camshaft but operably coupled to the crankshaft of the engine, and a brake drum coaxial with the camshaft. To change valve timing of the engine, the apparatus is adapted to vary the relative phase angle between the camshaft and the sprockets by putting a brake on a brake drum by means of an electromagnetic clutch, thereby retarding in rotation the brake drum relative to the sprockets via a phase varying mechanism such as helical splines.

A Patent Document 1 cited below discloses an electromagnetic-brake mounting structure for use with a phase varying apparatus. This electromagnetic clutch (electromagnetic brake) is supported by an electromagnetic-clutch cover (engine casing), and get stopped relative to the electromagnetic-clutch cover by means of plural pins formed on the rear end of the clutch cover and inserted in the holes formed in the cover, as shown in FIG. 3.

PRIOR ART DOCUMENT

Patent Document

PATENT DOCUMENT 1 JPA Laid Open 2008-19817

BRIEF DESCRIPTION OF THE INVENTION

Objects of the Invention

The rotation stopping structure employed in the electromagnetic brake mounting structure disclosed in Patent Document 1 has rotation stopping pins protruding in the axial direction of the camshaft, which poses a problem in making an axially short phase varying apparatus.

To circumvent this problem, the present invention is directed to provide an improved electromagnetic-clutch rotation stopping structure that can minimize the phase varying apparatus in axial dimension than conventional ones. MEANS FOR

Means for Achieving the Object

To achieve the object above, there is provided, in accordance with the present invention as claimed claim 1, an electromagnetic-clutch rotation stopping structure for stopping the rotation of an electromagnetic clutch of a phase varying apparatus equipped with: (1) a sprocket and a brake drum coaxially supported by the camshaft for relative rotation thereto and driven by the crankshaft of an automobile engine; (2) an electromagnetic clutch cover (70) having a clutch holding section (71*c*) formed in the circumferential surface thereof coaxially with the camshaft; and (3) a cylindrical electromagnetic clutch that is coaxial with the brake drum and adapted to put a brake on the brake drum as needed to change the phase angle between the camshaft and the crankshaft when stopped by the electromagnetic clutch cover unrotatable relative to the electromagnetic clutch cover, the electromagnetic-clutch rotation stopping structure is characterized by comprising:

a substantially C-shaped leaf spring for holding the electromagnetic clutch in the same radial plane as the leaf spring mounted on the circumferential surface of the clutch holding section;

first rotation stopping means provided between the electromagnetic clutch holding section and leaf spring; and second rotation stopping means provided between the leaf spring and electromagnetic clutch.

(Function) The electromagnetic clutch is held in the clutch holding section of the electromagnetic clutch cover via the substantially C-shaped leaf spring. In this configuration, the electromagnetic clutch is aligned in radial direction with the circumferential surface of the clutch holding section. The electromagnetic clutch is held unrotatable relative to the clutch holding section by means of the first and second rotation stopping means via the C-shaped leaf spring. Then, since the C-shaped leaf spring and the first and second rotation stopping means are maintained unrotatable while keeping the electromagnetic clutch aligned with the clutch holding section of the electromagnetic clutch cover in the radial direction (that is, perpendicular to the axial direction of the camshaft), an axially short electromagnetic-clutch rotation stopping structure, and hence phase varying apparatus, is realized.

The electromagnetic-clutch rotation stopping structure of Claim 1 may be provided in the configuration as defined in Claim 2, wherein the first rotation stopping means includes a pair of a recess and a protrusion for firmly securing the leaf spring on the electromagnetic clutch cover, the protrusion formed on either the electromagnetic clutch cover or the leaf spring the protrusion protruding in the radially outward direction of the camshaft and the recess formed in either the electromagnetic clutch cover or the leaf spring to engage with said protrusion; and the second rotation stopping means includes a pair of a recess and a protrusion for stopping the rotation of the electromagnetic clutch relative to the leaf spring, the protrusion formed on the either the electromagnetic clutch or the leaf spring and protruding in the radially outward direction of the camshaft, and the recess formed in either the electromagnetic clutch or the leaf spring to engage with the protrusion.

(Function) By arranging the first pair of engaging protrusion and recess (first rotation stopping means) formed on the electromagnetic cover and the leaf spring associated therewith and the second pair of engaging protrusion and recess (second rotation stopping means) formed on the electromagnetic clutch and the leaf spring associated therewith in alignment with each other in the radial directions of the electromagnetic clutch, the electromagnetic clutch can be firmly locked with the electromagnetic cover via the leaf spring. Since the first and second rotation stopping means are composed of radially outward or inward recesses and protrusions on the same radial plane, the rotation stopping structure can be minimized in axial length.

The electromagnetic-clutch rotation stopping structure according to Claim 2 may be provided in the configuration as defined in Claim 3, wherein the protrusions and the recesses have arcuate cross sections.

In order to absorb a shock that acts on the electromagnetic clutch and the clutch cove when the brake drum is subjected to braking action of the electromagnetic clutch, the conventional electromagnetic-clutch rotation stopping structure disclosed in Patent Document 1 requires a rubber absorbing member provided between the rotation stopping pins protruding from the electromagnetic clutch and pin-receiving holes formed in the electromagnetic clutch cover. However, such rubber shock absorber is limited in use in that it cannot be used at a high temperature or at a very low temperature.

The rotation stopping structure according to Claim 3 is not limited in use by temperature, since the recesses and protrusions formed between the electromagnetic clutch cover and the leaf spring, and between the leaf spring and the electromagnetic clutch have arcuate cross sections, which allows the leaf spring to absorb a shock that might be otherwise transmitted from the clutch-holding section of the electromagnetic cover to the electromagnetic clutch during braking of the brake drum.

The electromagnetic-clutch rotation stopping structure of Claim 3 may by provided in the configuration as defined in Claim 4, wherein the recesses have larger curvatures than the protrusions.

(Function) With the protrusions forced in the recesses having larger curvatures than those of the protrusions, engagement of the protrusions with the recesses are enhanced.

Further, when the protrusions come into engagement with the recesses, the leaf spring is pulled in the circumferential direction, which generates a centripetal force that acts on the electromagnetic clutch, thereby causing the center of the electromagnetic clutch to be positioned in axial alignment with the electromagnetic-clutch holding section.

Results of the Invention

Since the electromagnetic-clutch rotation stopping structure according to Claim 1 for a phase varying mechanism comprises leaf springs arranged in the radial direction of the electromagnetic clutch the axial dimension of the rotation stopping structure can be decreased, thereby rendering the phase varying apparatus compact.

Since the electromagnetic-clutch rotation stopping structure according to Claim 2 comprises of radial recesses and protrusions provided between the electromagnetic clutch and a leaf spring and between a leaf spring and the electromagnetic clutch cover, the stopping structure can be short in axial length, thereby allowing provision of a compact phase varying apparatus short in axial length.

With the electromagnetic-clutch rotation stopping structure having an arrangement according to Claim 3, the structure can be used at high temperatures conventionally not allowed, since the structure avoids use of a temperature dependent shock absorber made of, for example, a rubber.

In the electromagnetic-clutch stopping structure according to claim 4, engagement of the protrusions with the recesses is enhanced, thereby fixedly and securely stopping the electromagnetic-clutch on the electromagnetic clutch cover. In addition, the center of the electromagnetic clutch is then axially aligned with the center of the electromagnetic-clutch holding section.

BRIEF DESCRIPTION OF THE DRAWINGS

FIG. 5(*b*) shows a cross section of the apparatus taken along line B-B of FIG. 3.

FIG. 7(*b*) taken along line D-D of FIG. 3; and FIG. 7(*c*) taken along line E-E of FIG. 3.

FIG. 8(*b*) taken along line D-D of FIG. 3; and FIG. 8(*c*) taken along line E-E of FIG. 3.

BEST MODE FOR CARRYING OUT THE INVENTION

A phase varying apparatus utilizing an electromagnetic-clutch rotation stopping structure in accordance with a first embodiment of the invention will now be described in detail with reference to FIGS. 1 through 8. The apparatus is installed on an automobile engine. To vary the valve timing of exhaust/suction valves of the engine in synchronism with the crankshaft, the apparatus is adapted to vary the phase angle between the sprocket rotated by the crankshaft of the engine and the camshaft of the structure.

Figure 1:
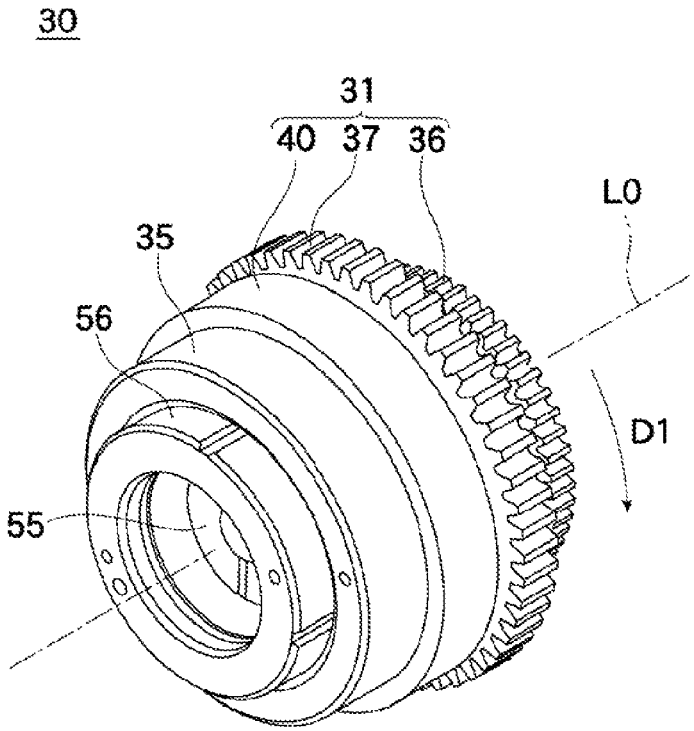
FIG. 1 shows a perspective view of a phase varying apparatus utilizing an electromagnetic-clutch rotation stopping structure of the invention.
Figure 2:
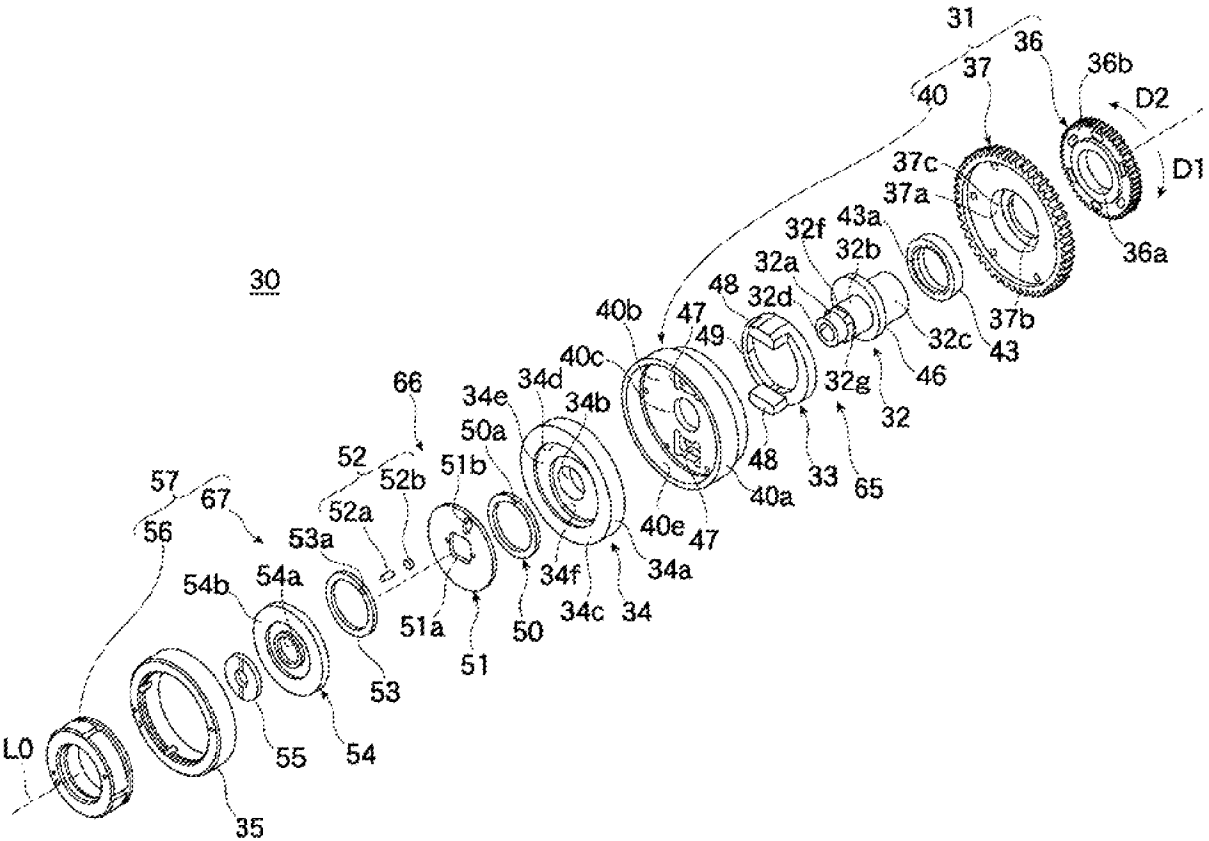
FIG. 2 shows an exploded perspective view of the apparatus shown in FIG. 1.
Figure 3:
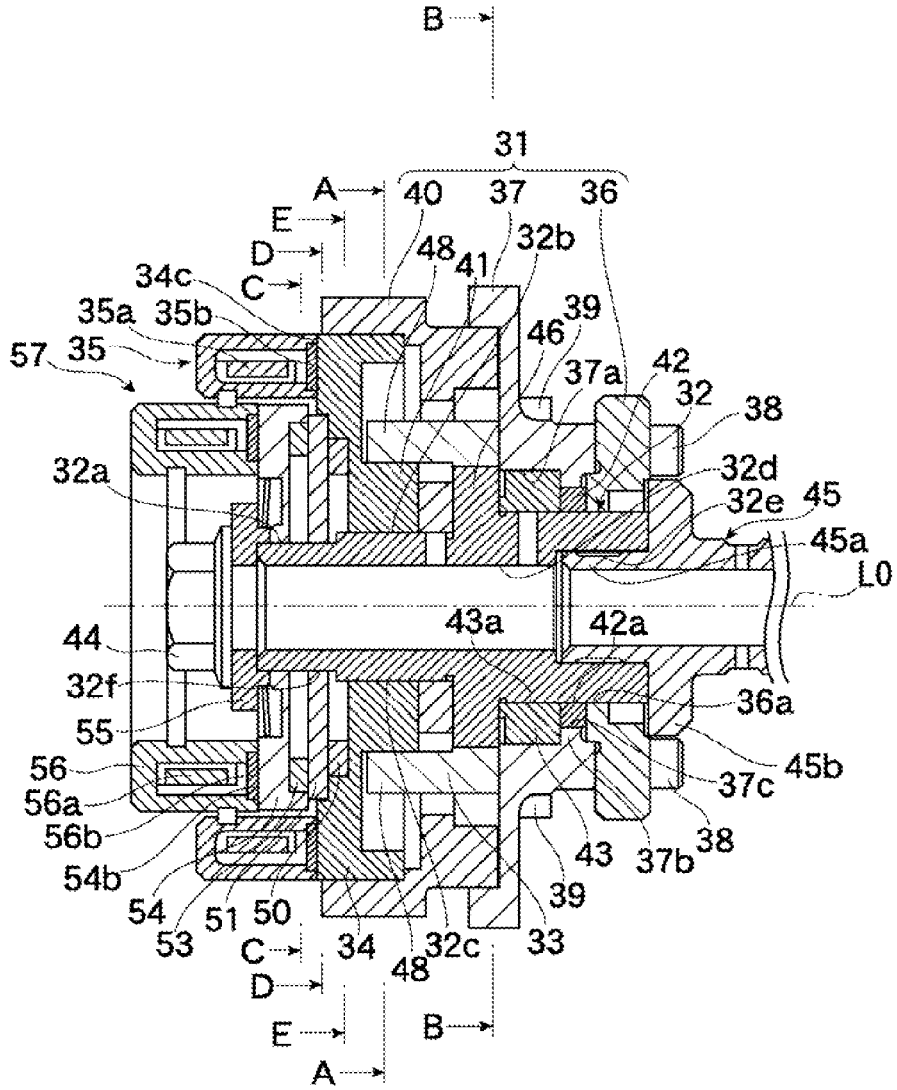
FIG. 3 shows an axial cross section of the apparatus shown in FIG. 1.

The phase varying apparatus 30 of the embodiment includes a drive rotor 31, center shaft 32, first brake drum 34, phase angle varying mechanism 65, and torque means 66, all coaxially aligned with the rotational axis L0 of the phase varying apparatus 30. The phase angle varying mechanism 65 consists of a first circular eccentric cam 41, cam guide member 33 and second circular eccentric cam 46. The torque means 66 consists of a first electromagnetic clutch 35 and reverse rotation mechanism 57. In what follows the end of the apparatus having the second electromagnetic clutch 56 will be referred to as front end, and the end having the sprocket 36 will be referred to as the rear end, as seen in FIG. 2. The clockwise direction D1 of the drive rotor 31 as seen from the front end will be referred to as phase advancing direction, while the counterclockwise direction D2 will be referred to as phase retarding direction.

The drive rotor 31 comprises two sprockets (36, 37) and a drive cylinder 40 integral with the sprockets. They are driven by the crankshaft. Each of the sprockets 36 and 37 has a central hole (36*a* and 37*a*). Provided inside the circular hole 37*a* is an inner flange 37*b*. The inner flange 37*b* has a central hole 37*c* for receiving therein a disc spring 42 having a central hole 42*a*. A holder 43 having a central hole 43*a* is fitted in the circular hole 37*a*.

On the other hand, the drive cylinder 40 has a cylindrical section 40*a* and a bottom section 40*b* integral with the cylindrical section 40*a*. Formed in the bottom section 40*b* are a pair of symmetric guide grooves 47 formed on the opposite sides of the central circular hole 40*c*, extending substantially in the radial directions of bottom section 40*b* (the grooves hereinafter referred to as radial guide grooves 47). In what follows the line that passes through the rotational axis L0 and extends along the radial guide grooves 47 will be referred to as line L3 (FIG. 4(*a*)).

The sprocket 36 is integrated with the sprocket 37 by means of coupling pins 38. The sprocket 37 is in turn integrated with the drive cylinder 40 by means of coupling pins 39.

The leading cylindrical section 45*a* is fitted in a coupling hole 32*e* formed in the rear end of the center shaft 32 and fixed by a bolt 44 inserted through a bolt insertion hole 32*d* and screwed into the camshaft 45, thereby making the center shaft 35 integral with the camshaft 45. A small cylindrical section 32*a*, intermediate cylindrical section 32*b*, second circular eccentric cam 46, and large cylindrical section 32*c* are coaxially arranged along the rotational axis L0 in the order mentioned from the front end.

The drive rotor 31 is supported by the center shaft 32 so as to be rotatable relative to the camshaft 45 by inserting the large cylindrical section 32*c* into the respective circular holes 36*a*, 42*a*, and 43*a*, and inserting intermediate cylindrical section 32*b* in the drive cylinder 40.

The second circular eccentric cam 46 is arranged adjacent the bottom section 40*b* of the drive cylinder 40 with its central axis L2 offset from the rotational axis L0 of the center shaft 32 by a distance d2. Hence the second circular eccentric cam 46 is eccentrically rotatable together with the center shaft 32 about the rotational axis L0.

On the other hand, the cam guide member 33 has an oblong hole 49 and a pair of cam holding sections 48 projecting forward from the peripheral rim of the cam guide member 33. The cam holding sections 48 have the same width and spacing with the radial guides grooves (47) of the drive cylinder 40. The oblong hole 49 extends in the direction LA perpendicular to the line that connects the cam holding sections 48 (FIG. 4(*b*)). Slidably fitted in the oblong hole 49 is the second circular eccentric cam 46 with the upper and lower ends of thereof kept in contact with the inner circumferential surface of the oblong hole 49.

The cam guide member 33 is arranged between the sprocket 37 and the drive cylinder 40, and is supported by the center shaft 32 via the second circular eccentric cam 46 fitted in the oblong hole 49. Each of the cam holding sections 48 has an end that engages with a corresponding one of the radial guide grooves 47 and protrudes forward from the groove. When the second circular eccentric cam 46 is eccentrically rotated in the oblong hole 49, the cam holding sections 48 are displaced in the radial direction.

The first brake drum 34 is inscribed in the cylindrical section 40*a* so that it is supported by the inner circumferential surface 40*e* of the cylindrical section 40*a*. As a consequence, the first brake drum 34 is rotatable about the rotational axis L0 relative to the drive cylinder 40. The first brake drum 34 is provided on the rear end thereof with a first circular eccentric cam 41 protruding rearward, and has a central circular hole 34*h* for passing therethrough the intermediate cylindrical section 32*b* of the center shaft 32.

The central axis L1 (eccentric point) of the first circular eccentric cam 41 is offset from the rotational axis L0 of the first brake drum 34 by a distance d1, so that the first circular eccentric cam 41 is eccentrically rotated about the rotational axis L0 together with the first brake drum 34. The first circular eccentric cam 41 is inscribed and held in the cam holding sections 48 protruding out of the radial guide grooves 47.

Provided ahead of the first brake drum 34 are the first electromagnetic clutch 35 and reverse rotation mechanism 57. The first electromagnetic clutch 35 (or first brake means) has a ring geometry and is fixedly secured coaxially with the rotational axis L0 by an electromagnetic clutch cover 70 (described in detail later) at a position to face the front end (contact face 34*c*) of the first brake drum 34. When the coil 35*a* of the ring-shaped first electromagnetic clutch 35 is energized, the first electromagnetic clutch 35 attracts the front end (contact face 34*c*) of the first brake drum 34 in rotation together with the drive rotor 31, and brings the front end into contact with the friction member 35*b*.

The reverse rotation mechanism 57 consists of a second brake drum 54, second electromagnetic clutch 56, and ring mechanism 67. The ring mechanism 67 consists of a first ring member 50, an intermediate rotor 51, movable member 52, second ring member 53 arranged in the circular stepped hole 54*c* formed on the rear end of a second brake drum 54, and the second brake drum 54.

The first brake drum 34 has a circular stepped hole 34*d* in the front end of the brake drum. The circular stepped hole 34*d* has on the bottom section 34*f* thereof a first circular eccentric stepped hole 34*f*. The first circular eccentric hole 34*f* has a center O1 offset from the rotational axis L0 of the center shaft 32 by a distance d3. The first ring member 50 is slidably inscribed in the first circular eccentric hole 34*f*. Formed in the front end of the first ring member 50 is a first engagement hole 50*a*.

Figure 7:
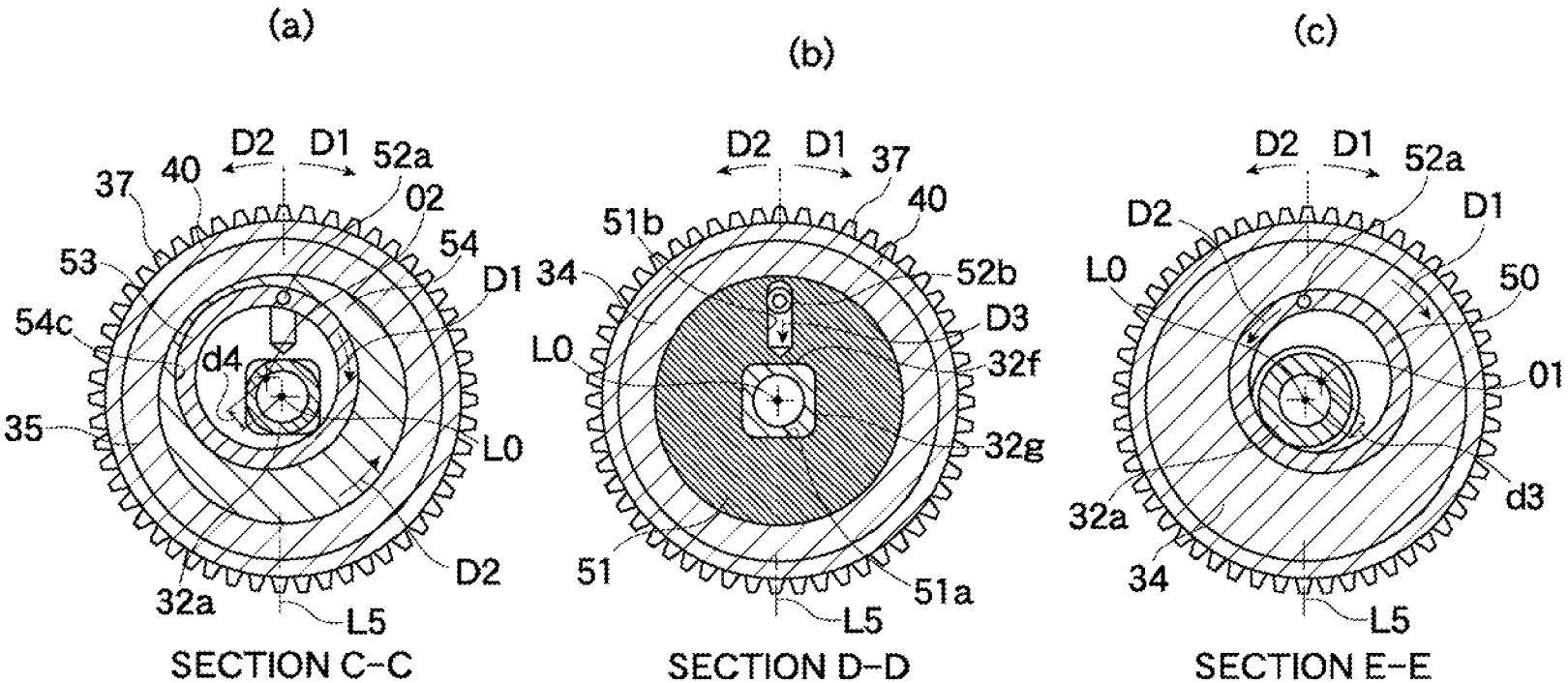
FIG. 7 shows in radial cross section an arrangement of a rotation reversing structure under a given initial condition. More particularly, FIG. 7(*a*) is a cross section taken along line C-C of FIG. 3.
Figure 8:
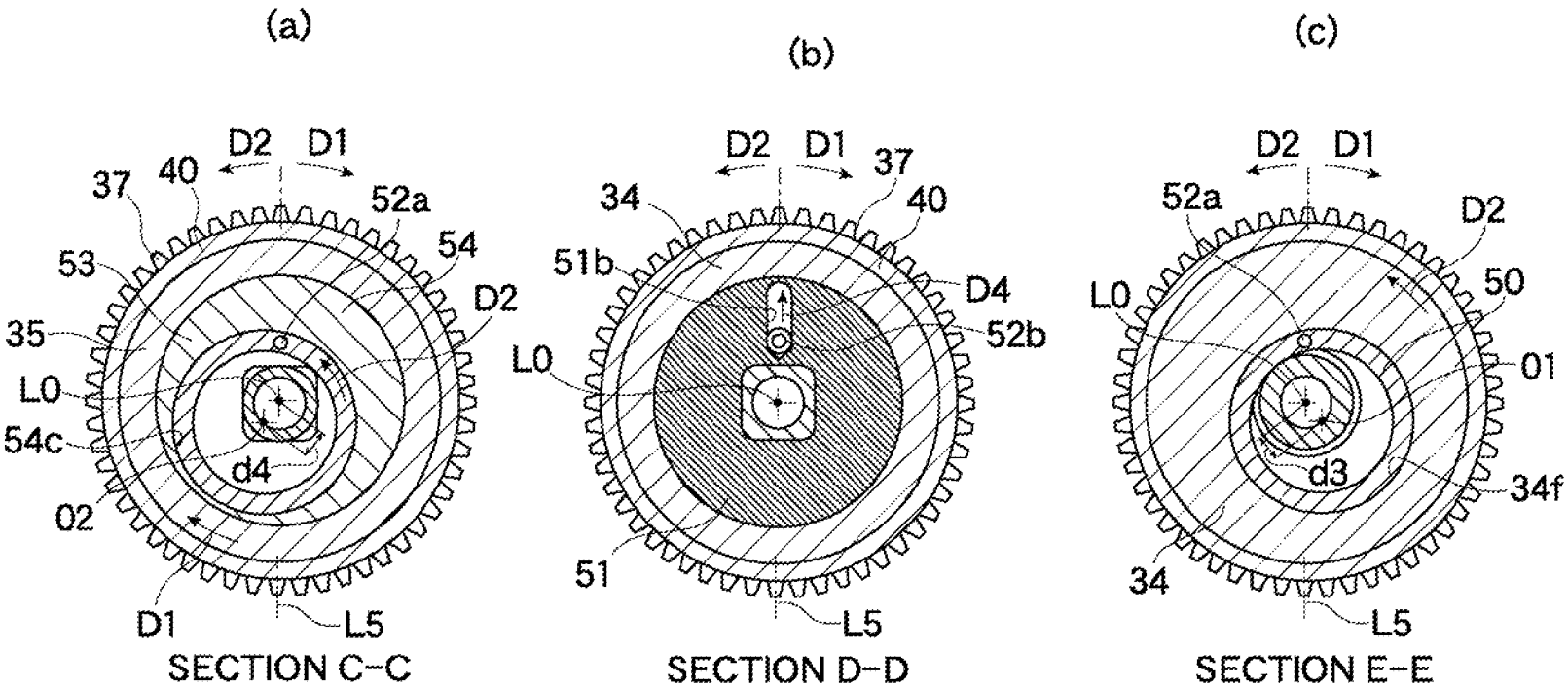
FIG. 8 shows in radial cross section of the rotation reversing structure after a certain change has taken place in the phase. More particularly, FIG. 8(*a*) is a cross section taken along line C-C of FIG. 3.

The intermediate rotor 51 has a central square hole 51*a*, and a guide groove 51*b* formed outside the square hole 51*a* to extend in the substantially radial direction of the intermediate rotor 51 (the groove hereinafter referred to as radial guide groove 51*b*). The flat engagement faces 32*f* and 32*g* of the center shaft 32 are engaged with the square hole 51*a* to securely fix the intermediate rotor 51 to the center shaft 32. The line passing through the rotational axis L0 of the intermediate rotor 51 and extending along the radial guide groove 51*b* will be referred to as line L5 (FIG. 7).

The second brake drum 54 has a central circular hole 54*a*, and, in the rear end thereof, a second circular eccentric stepped hole 54*c* having a center O2 offset from the rotational axis L0 by a distance d4. The second brake drum 54 is rotatably supported on the center shaft 32 by the small cylindrical section 32*a* inserted in the circular hole 54*a*. The second ring member 53 is slidably inscribed in the second circular stepped hole 54*c*. The second ring member 53 has on the rear end thereof a second engagement hole 53*a*. The first and second ring members 50 and 53, respectively, have their centers O1 and O2 located on the opposite sides of the line L5.

The movable member 52 is constituted of a thick hollow shaft 52*b* and a thin shaft 52*a* inserted in the thick hollow shaft 52*b*. The opposite ends of the thin shaft 52*a* are in slidable engagement with the first and second engagement holes 50*a* and 50*b*, respectively, thereby coupling the first ring member 50 and second ring member 53 together. The thick hollow shaft 52*b* can be displaced in the engaging radial guide groove 51*b*.

A holder 55 is arranged at the leading end of the small cylindrical section 32*a* of the center shaft 32 projecting from the circular hole 54*a*. Members arranged between the holder 55 and the sprocket 36 inclusive are securely held on the camshaft 45 by means of a bolt 44 screwed into the leading end of camshaft 45 through the central holes formed in the respective members.

The second electromagnetic clutch 56 has a ring geometry and is secured by an electromagnetic clutch cover 70 (described later) so as to be coaxial with the rotational axis L0 and face the front end of the second brake drum 54. When the coil 56*a* is energized, the second electromagnetic clutch 56 attracts the contact face 54*b* of the second brake drum 54, bringing the contact face 54*b* in contact with the friction member 56*b*, thereby putting a brake on the second brake drum 54.

Next, operation of the phase varying apparatus 30 will be described. Under the initial condition prior to any phase change, the center shaft 32, cam guide member 33, and first brake drum 34 are in rotation in D1 direction about the rotational axis L0 together with the drive rotor 31 as driven by the crankshaft (not shown).

When the first electromagnetic clutch 35 is activated, the contact face 34*c* and friction member 35*b* come into sliding contact with each other. As a consequence, the first brake drum 34 is retarded in rotation relative to the drive rotor 31, or rotated in the phase retarding direction D2 relative to the drive rotor 31, as shown in FIGS. 2 and 4.

Figure 4:
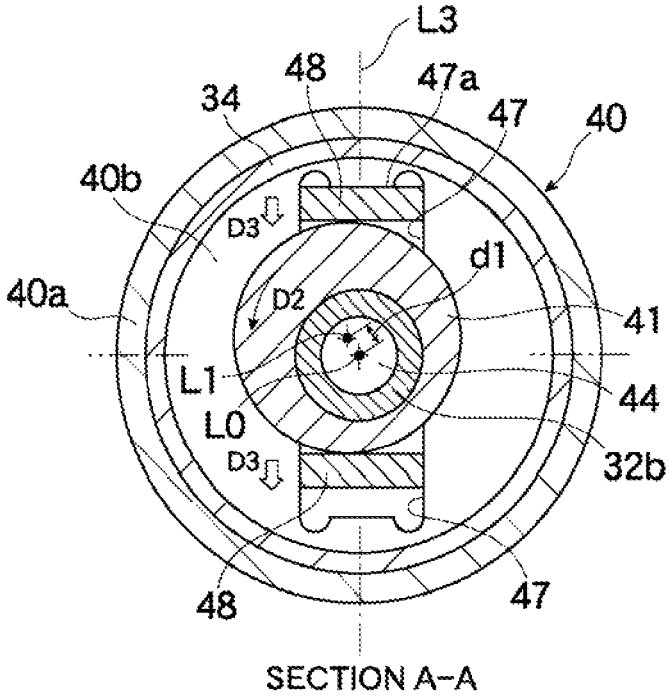
FIG. 4 shows radial cross section of a phase varying apparatus (initially set in a phase retarding mode) in accordance with a first embodiment of the invention. More particularly, FIG. 4(*a*) shows in cross section an arrangement of a first circular eccentric cam, the cross section taken along line A-A of FIG. 3, and FIG. 4(*b*) shows in cross section an arrangement of a second circular eccentric cam in the phase retarding mode, the cross section taken along line B-B of FIG. 3.
Figure 4:
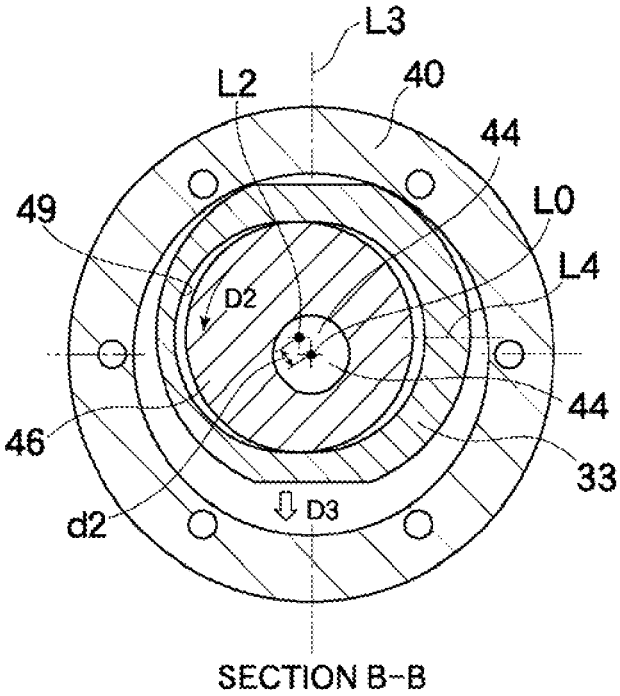

In this instance, the first circular eccentric cam 41 rotates about the rotational axis L0 in the clockwise direction D2 together with the first brake drum 34, as shown in FIG. 4(*a*). The cam holding sections 48 of the cam guide member 33 are displaced in the radial guide grooves 47 in the downward direction D3 by the inscribed first circular eccentric cam 41. The cam guide member 33 is moved in the downward D3 direction together with the cam holding sections 48.

As shown in FIG. 4(*b*), the second circular eccentric cam 46 is acted upon by a force exerted by the wall of the oblong hole 49 and is eccentrically rotated in the counterclockwise direction D3 as the cam guide member 33 moves downward. Since the center shaft 32 (camshaft 45) is integrated with the second circular eccentric cam 46, it is rotated in D2 direction relative to the drive rotor 31. As a consequence, the phase angle of the camshaft 45 relative to the drive rotor 31 (not shown) is altered in the counterclockwise direction D2 (phase retarding direction) to change the valve timing of the engine.

On the other hand, the phase angle thus changed will be returned to its initial angle if the second electromagnetic clutch 56 of the reverse rotation mechanism is operated.

As the second electromagnetic clutch 56 shown in FIG. 2 is activated, the second brake drum 54 is rotated in phase retarding direction D2 under the braking action of the second electromagnetic clutch 56, that is, retarded in rotation relative to the intermediate rotor 51 and first brake drum 34 as shown in FIG. 7(*a*). The second ring member 53 then slides inside the circular stepped hole 54*c* and causes the movable member 52 to be displaced downward in the radial guide groove 51*b* (downward D3 direction as shown in FIG. 7(*b*)). As the movable member 52 is displaced in D3 direction, the first ring member 50 of FIG. 7(*c*) slides inside the first circular eccentric hole 34*f*, providing the first brake drum 34 with a torque for rotation in D direction. As a consequence, the first brake drum 34 is rotated in the phase advancing direction D1 relative to the drive rotor 31, in the opposite direction of the rotation caused by the first electromagnetic clutch 35.

Figure 5:
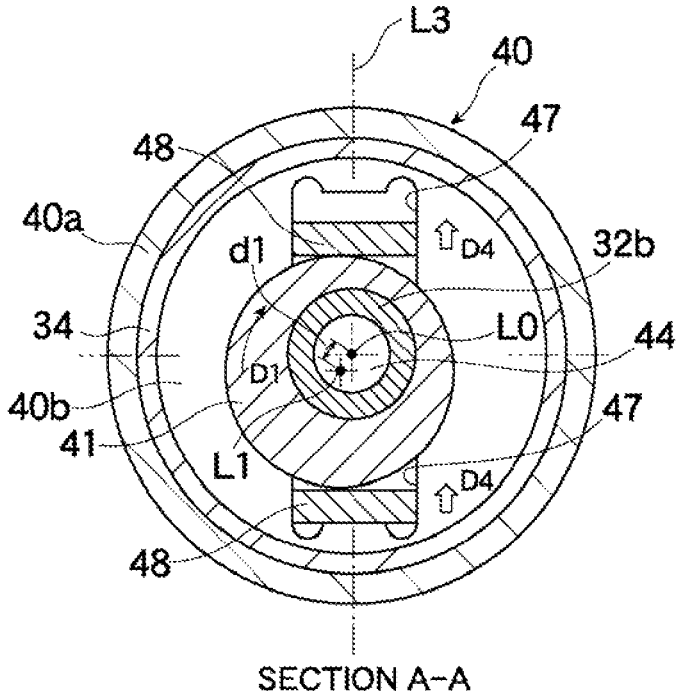
FIG. 5 shows a radial cross section of the phase angle varying apparatus in phase retarding mode after a change has taken place in the phase angle. More particularly, FIG. 5(*a*) shows a cross section of the apparatus taken along line A-A of FIG. 3.
Figure 5:
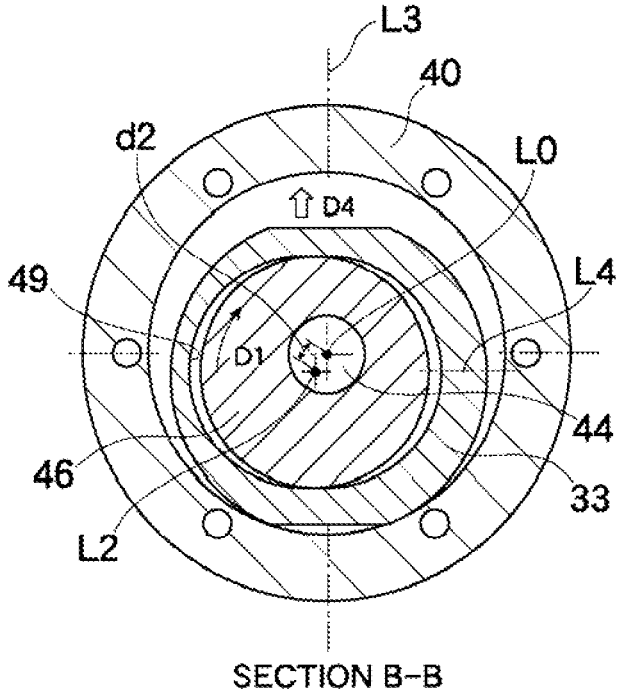
Figure 6:
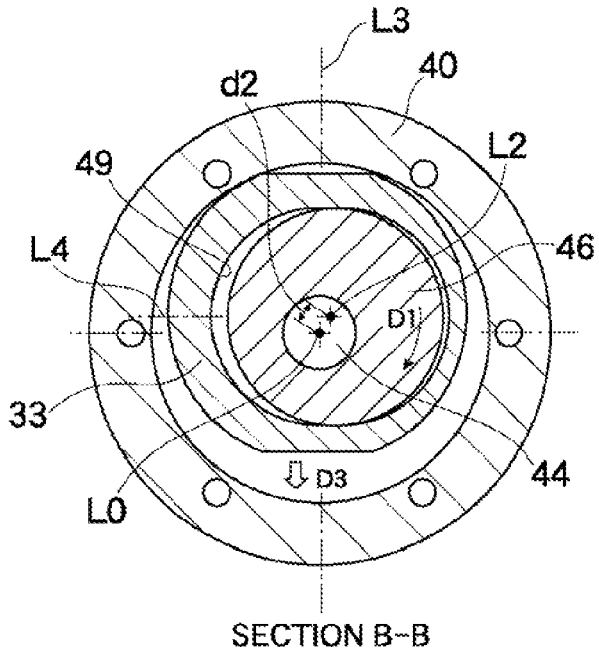
FIG. 6 shows in cross section an arrangement of a second circular eccentric cam set in a phase advancing mode.
Figure 6:
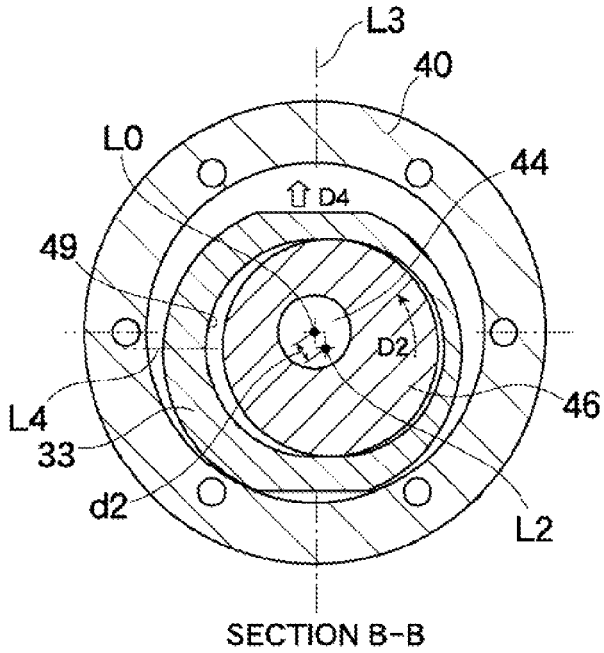

As the first brake drum 34 is rotated in the phase advancing direction D1 relative to the drive rotor 31, the first circular eccentric cam 41 is eccentrically rotated in the clockwise direction D1 about the rotational axis L0 as shown in FIG. 5(*a*), thereby causing the cam holding sections 48 and cam guide member 33 to be moved upward (D4 direction) in the radial guide grooves 47. As the cam guide member 33 moves upward, the second circular eccentric cam 46 (center shaft 32) shown in FIG. 5(*b*) is rotated in the phase advancing direction D1 relative to the drive rotor 31. As a consequence, the phase angle of the crankshaft relative to the drive rotor 31 is returned toward the initial angular position and sets back the valve timing.

Figure 9:
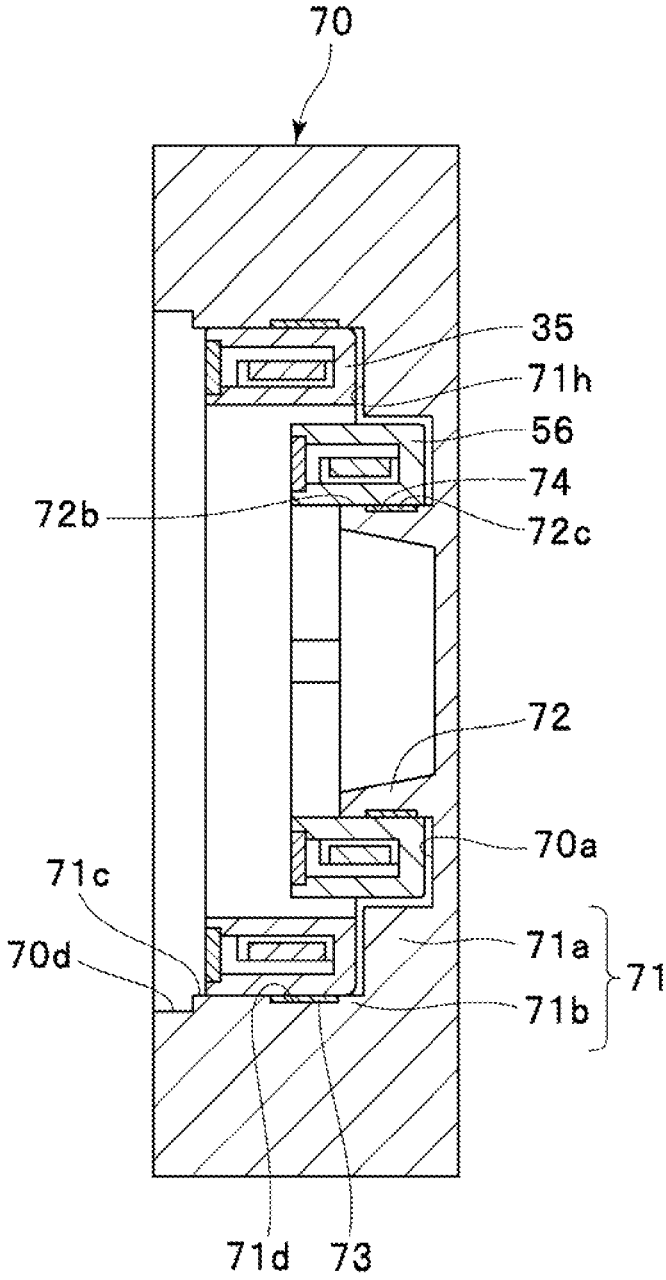
FIG. 9 is an axial cross section of an electromagnetic-clutch rotation stopping structure
Figure 10:
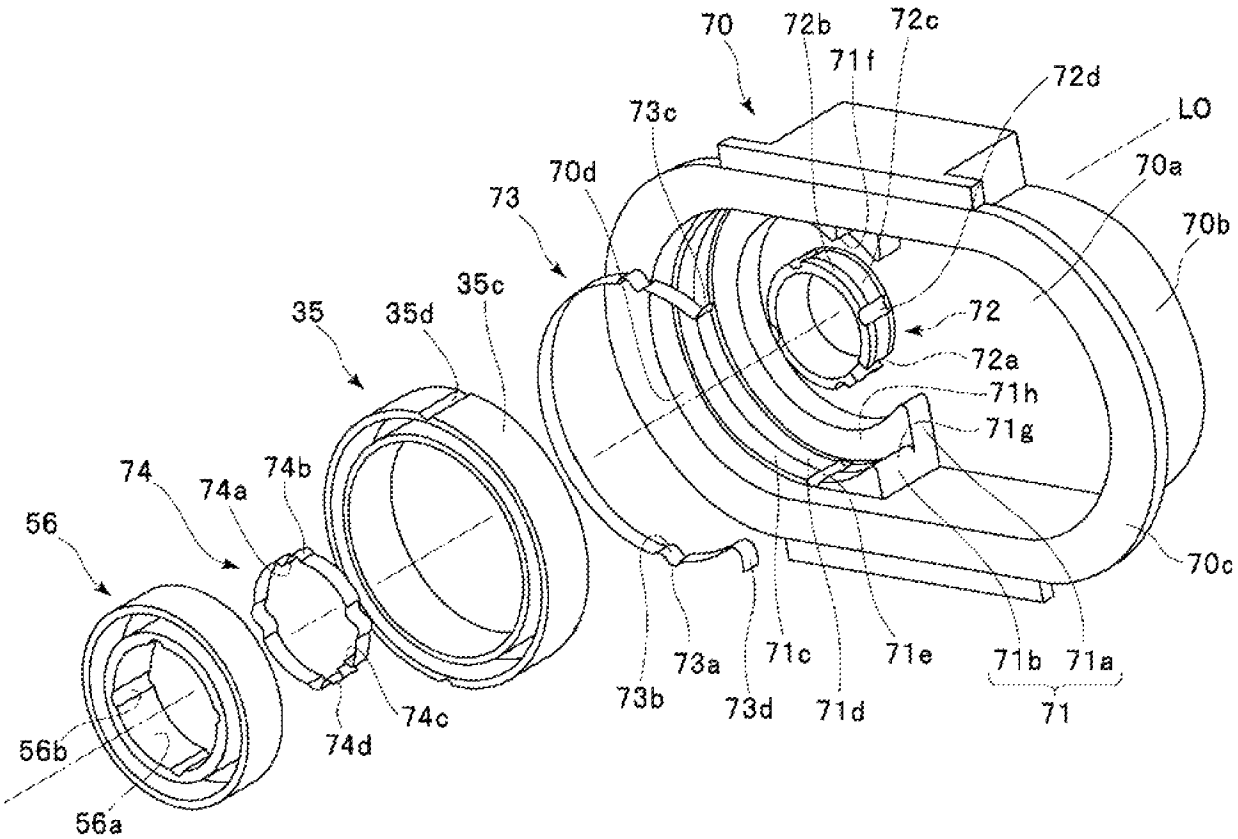
FIG. 10 is an exploded schematic view of an electromagnetic-clutch rotation stopping structure.

The electromagnetic-clutch rotation stopping structure of the present invention will now be described in detail below. The electromagnetic-clutch rotation stopping structure of the present embodiment is shown in FIGS. 9 and 10.

Reference numeral 70 indicates an electromagnetic clutch cover, made of a metal (such as aluminum), for fixing the first and second electromagnetic clutch 35 and 56, respectively, to the engine (not shown). The left end of the electromagnetic clutch cover 70 shown in these figures is directed towards the front of the automobile, while the second electromagnetic clutch 56 is directed towards the rear of the automobile. The electromagnetic clutch cover 70 comprised of a top plate 70*a*, a cylindrical section 701) which is oblong in the direction perpendicular to the rotational axis L0, and a flange section 70*c* formed at the edge of the rear opening of oblong cylindrical section 70*b*, all integrated together. The top plated 70*a* is provided with a first clutch holding section 71 for holding the first electromagnetic clutch 35, and a second clutch holding section 72 for holding the second electromagnetic clutch 56.

The second clutch holding section 72 extends rearward from the top plate 70*a* coaxially with the first and second electromagnetic clutches 35 and 56, respectively. The second clutch holding section 72 has a cutaway 72*a* extending in the axial direction and a circumferential stepped recess 72*c* formed in its peripheral surface 72*b*. The second clutch holding section 72 is also provided with a multiplicity of recesses 72*d* formed in the peripheral surface 72*b*. The recesses extend in the axial direction. When viewed in the transverse cross section, the recesses have an arcuate shape dent to the step portions 72*c*.

A C-shaped second leaf spring 74 made of a stainless steel for example is fitted on the circular the step portion 72*c* to achieve axial positioning of the second clutch holding section 72. The second leaf spring 74 has a C-shape geometry and is provided with a multiplicity of waving protrusions (74*a*, 74*b*) that protrude radially inwardly and outwardly. Formed at the opposite ends of the second leaf spring 74 are inwardly flipped sections (74*c* or 74*d*). These radially inward protrusions 74*a* are spaced apart at the same angular intervals as the recesses 72*d* of the second clutch holding section 72 and have a smaller curvature than the recesses 72*d*. The protrusions 74*a* of the second leaf spring 74 are forced in the corresponding recesses 72*d* having a larger curvature than the radially inward protrusions 74*a* for firm engagement therewith. The flipped sections 74*c* and 74*d* are engaged with the cutaway 72*a*. As a consequence, the protrusions 74*a* of the second leaf spring 74 and recesses 72*d* of the second clutch holding section 72 are securely engaged with each other, thereby unrotatably fixing the second leaf spring 74 to the second clutch holding section 72. Since the second electromagnetic clutch 56, second leaf spring 74, and second clutch holding section 72 are arranged to overlap in the radial direction, the rotation stopping structure has a minimized axial dimension.

Formed in the inner circumferential surface 56*a* of the ring-shaped second electromagnetic clutch 56 are multiplicity of recesses 56*b* spaced apart at the same angular intervals as the radially outward protrusions 74*b* of the second leaf spring 74. Each of the recesses 56*b* has an arcuate cross section having a curvature larger than that of a corresponding protrusion 74*b*.

The second electromagnetic clutch 56 is engaged with the second leaf spring 74 by forcing the protrusions 74*b* of the second leaf spring 74 having a small curvature forced into the recesses 56*b* having a larger curvature. As a consequence, protrusions 74*b* of the second leaf spring 74 and the recesses of the second electromagnetic clutch 56 (second rotation stopping means) are firmly engaged with each other, so that the second electromagnetic clutch 56 is unrotatably fixed to the second clutch holding section 72. It is noted that there is provided a clearance of about 1 mm between the second electromagnetic clutch 56 and the top plate 70*a* so that the second electromagnetic clutch can move within the clearance in the axial direction of the rotational axis L0 when the clutch is guided by the friction member 56*b* and protrusions 74*b*.

On the other hand, provided round the periphery of the second electromagnetic clutch 56., to be fixed to the second clutch holding section 72, is a first clutch holding section 71 for holding in position the first electromagnetic clutch 35. The first clutch holding section 71 is an integral body having an axial step portion 71*a* protruding rearward from the top plate 70*a* and a spring receiver 71*b* behind the step portion 71*a*. The spring receiver 71*b* has a generally circular inner circumferential surface 71*c* extending along the inner cylindrical surface 70*d* of the oblong cylindrical section 70*b*. The inner circumferential surface 71*c* has a cutaway portion, so that it has a C-shape transverse cross section. The diameter of the inner circumferential surface 71*c* equals the diameter of the first electromagnetic clutch 35 plus two times the thickness of a first leaf spring 73.

Formed in the inner circumferential surface 71*c* and adjacent the step portion 71*a* is a circular radial recess 71*d* (referred to as step portion 71*d*). There are also formed in the inner circumferential surface 71*c* a multiplicity of recesses 71*e* formed at equal angular intervals, each having an arcuate cross section extending in the axial direction across the stepped recess 71*d*.

The stepped recess 71*d* is positioned at an axially right position by mounting the first leaf spring 73 (which is made of a stainless steel for example, and has the same width as the stepped recess 71*d*) in the stepped recess 71*d*. The first leaf spring 73 has a C-shape geometry, and has waving protrusions 73*a* and 73*b* formed at multiple angular positions of the leaf spring 73 at equal intervals. The protrusions 73*a* protrude radially outwardly and protrusions 73*b* protrude radially inwardly. The first leaf spring 73 is also provided at the opposite ends thereof with outwardly flipped sections 73*c* and 73*d*. The radially outward protrusions 73*a* are formed at the same angular intervals as those of the recesses 71*e*, and have an arcuate cross section of a smaller curvature than that of the recess recesses 71*e*. The protrusions 73*a* of the first leaf spring 73 are force fitted to corresponding recesses 71*e* having a smaller curvature than these protrusions 73*a*, and the outwardly flipped sections 73*c* and 73*d* are engaged with the respective opposite ends 71*f* and 71*g* of the inner circumferential surface 71*c*. As a consequence, the protrusions 73*a* of the first leaf spring 73 are firmly engaged with the recesses 71*e* (first rotation stopping means) of the first clutch holding section 71 to stop the first leaf spring 73 relative to the first clutch holding section 71. The axial length of the rotation stopping mechanism of the first electromagnetic clutch 35 can be minimized in the same manner as the second electromagnetic clutch 56.

A multiplicity of recesses 35*d* are formed in the outer circumferential surface 35*c* of the ring-shaped first electromagnetic clutch 35 at the same angular intervals as those of the radially inward protrusions 73*b* of the first leaf spring 73. Each of the recesses 35*d* has an arcuate cross section extending in the radially inward direction, and has a larger curvature than that of the protrusions 73*b*.

The recesses 35*d* of the first electromagnetic clutch 35 are engaged with corresponding protrusions 73*b* having a smaller curvature than the recesses 71*e*. As a consequence, the protrusions 73*b* of the first leaf spring 73 and the recesses 35*d* of the first electromagnetic clutch 35 are securely engaged with each other. Thus, the first electromagnetic clutch 35 is firmly secured to the first clutch holding section 71 and stopped relative to the first clutch holding section 71. Incidentally, there is provided between the first electromagnetic clutch 35 and the stepping face 71*h* of the step portion 71*a* a minute clearance of about 1 mm, in which the second electromagnetic clutch 56 can move in the axial direction of the rotational axis L0 when it is guided by the recess 35*d* and protrusions 73*b*.

It should be understood that although arcuate cross sections are employed for the recesses and protrusions of the respective rotation stopping means (such as 73*a*, 71*e*) in the embodiment shown herein, cross sections of other geometries such as triangle or square can be used equally well. However, that recesses and protrusions having arcuate cross sections are preferred to those having sharp corners. By making the cross sections of the recesses and protrusions (74*a* and 74*h*) arcuate, a shock imparted from the clutch holding section to the electromagnetic clutch during braking is decreased. It is also noted that, since the leaf springs acting as shock absorbing members are made of a steel, the rotation stopping mechanism of the invention can be used at any temperature, particularly at higher temperatures than conventional ones.

In the embodiment shown and described herein, the number of waving protrusions (73*a* and 73*b*) distributed along the periphery of the first leaf spring 73 is less (two) than that (four) of the waving protrusions (74*a* and 74*b*). This is because the inner circumferential surface 71*c* (bearing the leaf spring 73) of the first clutch holding section 71 has a larger diameter than the second clutch holding section 72, and is capable of performing stopping of the electromagnetic clutch with a smaller torque. In other words, it is preferred to have a leaf spring mounted on the outer surface of the first electromagnetic clutch rather than mounted on the inner circumferential surface to decrease the number of the waving protrusions, thereby simplifying manufacture of the rotation stopping structure.

In the present embodiment, the electromagnetic clutch rotation stopping structure employs a double-clutch mechanism in which, in addition to the first electromagnetic clutch 35, the second electromagnetic clutch 56 is used in the reverse rotation mechanism of the brake drum 34. Instead, a single-electromagnetic clutch mechanism can be employed in which a spiral (coil) spring is used as the reverse rotation mechanism.

NOTATIONS

30 phase varying apparatus
34 first brake drum
35 first electromagnetic clutch
35*d* recesses (second rotation stopping means)
36 and 37 sprockets
45 camshaft
54 second brake drum
56 second electromagnetic clutch
56*b* recesses (second rotation stopping means)

70 electromagnetic clutch cover
71 first clutch holding section
71*c* inner circumferential surface of first clutch holding section
71*e* recesses (first rotation stopping means)
72 second clutch holding section
72 outer circumferential surface of second clutch holding section
72*d* recesses (first rotation stopping means)
73 first leaf spring
73*a* radially outward protrusions (first rotation stopping means)
73*b* radially inward protrusions (second rotation stopping means)
74 second leaf spring
74*a* radially inward protrusions (first rotation stopping means)
74*b* radially outward protrusions (second rotation stopping means)
L0 central axis of camshaft

The invention claimed is:

1. An electromagnetic-clutch rotation stopping structure for stopping the rotation of an electromagnetic clutch of a phase varying apparatus equipped with: a sprocket and a brake drum coaxially supported by the camshaft for relative rotation thereto and driven by the crankshaft of an automobile engine; an electromagnetic clutch cover (70) having a clutch holding section (71*c*) formed in the circumferential surface thereof coaxially with the camshaft; and a cylindrical electromagnetic clutch that is coaxial with the brake drum and adapted to put a brake on the brake drum as needed to change the phase angle between the camshaft and the crankshaft when stopped by the electromagnetic clutch cover unrotatable relative to the electromagnetic clutch cover, the electromagnetic-clutch rotation stopping structure is characterized by comprising:

a substantially C-shaped leaf spring for holding the electromagnetic clutch in the same radial plane as the leaf spring mounted on the circumferential surface of the clutch holding section;

first rotation stopping means provided between the electromagnetic clutch holding section and leaf spring; and second rotation stopping means provided between the leaf spring and electromagnetic clutch.

2. The electromagnetic-clutch rotation stopping structure according to claim 1, wherein the first rotation stopping means includes a pair of recess and a protrusion for firmly securing the leaf spring on the electromagnetic clutch cover, the protrusion formed on either the electromagnetic clutch cover or the leaf spring the protrusion protruding in the radially outward direction of the camshaft and the recess formed in either the electromagnetic clutch cover or the leaf spring to engage with said protrusion; and the second rotation stopping means includes a pair of recess and a protrusion for stopping the rotation of the electromagnetic clutch relative to the leaf spring, the protrusion formed on the either the electromagnetic clutch or the leaf spring and protruding in the radially outward direction of the camshaft, and the recess formed in either the electromagnetic clutch or the leaf spring to engage with the protrusion.

3. The electromagnetic-clutch rotation stopping structure according to claim 2, wherein the engaging surfaces of the recesses and protrusions have arcuate cross sections.

4. The electromagnetic-clutch rotation stopping structure according to claim 3 wherein the radii of curvatures of the recesses are larger than those of corresponding protrusions.

* * * * *